US006227883B1

(12) United States Patent
Lee et al.

(10) Patent No.: US 6,227,883 B1
(45) Date of Patent: May 8, 2001

(54) ELECTRIC COMBINATION SOCKET

(76) Inventors: Chiu-Shan Lee; S. S. Chen Li, both of No. 31, Lane 18, Chang-Chun Rd., Hsintien City, Taipei County (TW)

( * ) Notice: Subject to any disclaimer, the term of this patent is extended or adjusted under 35 U.S.C. 154(b) by 0 days.

(21) Appl. No.: 09/294,316

(22) Filed: Apr. 20, 1999

(51) Int. Cl.[7] ..... H01R 13/648
(52) U.S. Cl. ..... 439/106; 439/222; 439/653
(58) Field of Search ..... 439/222, 653, 439/106, 107, 108, 109, 223, 649, 650, 651, 652

(56) References Cited

U.S. PATENT DOCUMENTS 5,836,777 * 11/1998 Chen ..... 439/222

* cited by examiner

*Primary Examiner*—Paula Bradley
*Assistant Examiner*—Truc Nguyen
(74) *Attorney, Agent, or Firm*—Rosenberg, Klein & Lee

(57) ABSTRACT

An electric combination socket, which includes a socket body having a face panel, an upper round ground slot provided at the face panel on the middle at a top side, flat hot and neutral slots arranged in parallel at the face panel below the upper round ground slot for matching with the upper round ground slot to receive an electric plug from an electric home appliance, a flat ground slot provided at the face panel between the hot and neutral slots for matching with the hot and neutral slots to receive a computer power plug, and a coupling groove provided at the face panel around the hot and neutral slots and the flat ground slot for receiving the shell of a computer power plug, a ground terminal mounted in the flat ground slot, hot and neutral terminals respectively mounted in the hot and neutral slots, and a ground frame at a rear side of the socket body remote from the face panel, the ground frame comprising a top contact portion inserted into the upper round ground slot at the socket body, and a bridge portion disposed in contact with the ground terminal.

4 Claims, 10 Drawing Sheets

| CODE | APPLICATION AREA | SPECIFICATION |
|---|---|---|
| A | British standards: South Africa | 15A250V |
| B | British standards: HK, Malaysia, Uganda, Singapore, Arabian countries | 13A250V |
| C | British colonies, India | 5A250V<br>15A250V |
| D | China, New Zealand, Australia | 10A250V |
| E | Denmark | 15A250V |
| F | Middle East | 15A250V |
| G | Middle East | 15A250V |
| H | American standards: Taiwan, Japan, USA, Canada, Cuba, Venezuela, Costa Rica, Guam Dominique, Ecudor, Hawaii, Salvador Haiti, Honduras, Maxico, Panama, Nicalagua<br><br>Philippines, Thanland, Guatemala, Paragua | 125V<br><br>250V |
| I | Taiwan, Japan, USA, Canada | 20A250V |
| J | Taiwan, Japan, USA, Canada | 15A250V |
| K | China | |
| L | Italy | 10-16A250V |
| M | Swiss | 10-16A250V |
| N | Taiwan, Japan, USA, Canada<br>China, Philippines, Tailand | 15A250V<br>250V |
| O | China, New Zealand, Australia | 250V |
| P | Russia, Europe | small electric home appliance 250V |
| Q | German, Europe (with side grounding) | 10-16A250V |
| R | Conventional British and Hong Kong Types | 250V |

FIG.15

ELECTRIC COMBINATION SOCKET

BACKGROUND OF THE INVENTION

The present invention relates to electric sockets, and more particularly to an electric combination socket which is suitable for use with any of a variety of electric plugs.

FIG. 16 illustrates a standard electric socket 7 for computer for use with a standard electric plug 71 for computer. This structure of electric socket 7 cannot be used with an electric plug for a regular electric home appliance.

SUMMARY OF THE INVENTION

The present invention has been accomplished to provide a combination electric socket which is suitable for use with a standard electric plug for computer as well as any of a variety of electric plugs for electric home appliance. According to aspect of the present invention, the electric combination socket comprises a socket body having a face panel, an upper round ground slot provided at the face panel on the middle at a top side, flat hot and neutral slots arranged in parallel at the face panel below the upper round ground slot for matching with the upper round ground slot to receive an electric plug from an electric home appliance, a flat ground slot provided at the face panel between the hot and neutral slots for matching with the hot and neutral slots to receive a computer power plug, and a coupling groove provided at the face panel around the hot and neutral slots and the flat ground slot for receiving the shell of a computer power plug, a ground terminal mounted in the flat ground slot, hot and neutral terminals respectively mounted in the hot and neutral slots, and a ground frame at a rear side of the socket body remote from the face panel, the ground frame comprising a top contact portion inserted into the upper round ground slot at the socket body, and a bridge portion disposed in contact with the ground terminal. According to another embodiment of the present invention, the hot and neutral slots each are formed of a flat slot and a British rectangular slot. According to still another embodiment of the present invention, the hot and neutral slots each are formed of a flat slot, an oblique slot, and a round slot. According to still another embodiment of the present invention, a round ground slot and round hot and neutral slots provided at the face panel for receiving an electric socket fitting South Africa's national electric specifications.

BRIEF DESCRIPTION OF THE DRAWINGS

FIG. 15 is an application table of the present invention.

DETAILED DESCRIPTION OF THE PREFERRED EMBODIMENT

Figure 1:
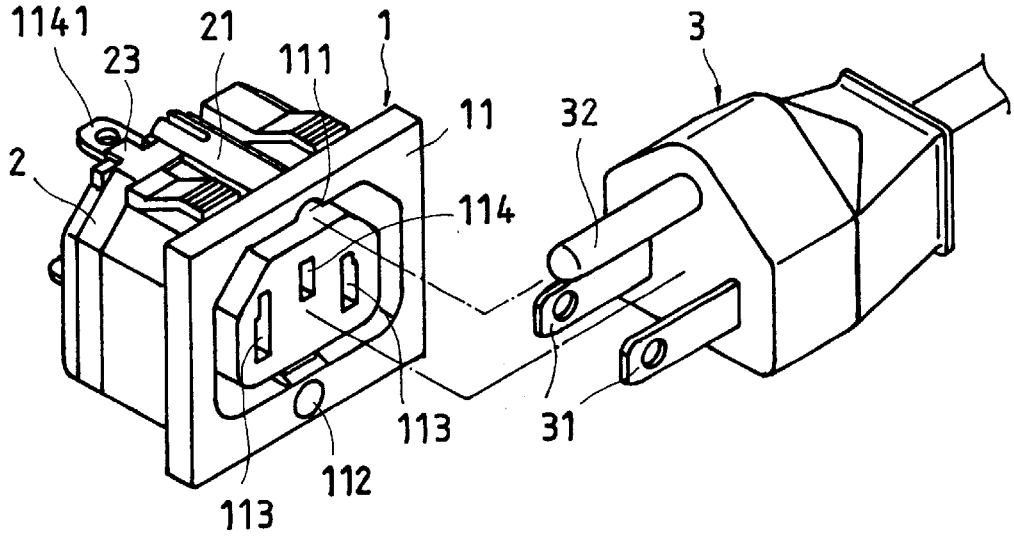
FIG. 1 shows the relationship between a combination electric socket according to a first embodiment of the present invention and a regular electric plug.

Referring to Figures from 1 through 5, a combination electric socket 1 is shown comprising a face panel 11, an upper round ground slot 111 and a lower round ground slot 112 provided at the face panel 11 on the middle at different elevations, flat hot and neutral slots 113 arranged in parallel at the face panel 11 between the round ground slots 111 and 112, a flat ground slot 114 provided at the face panel 11 between the hot and neutral slots 113, a ground terminal 1141 mounted in the flat ground slot 114, hot and neutral terminals 1131 respectively mounted in the hot and neutral slots 113, and a ground frame 2 at the rear side. The ground frame 2 comprises a top contact portion 21 and a bottom contact portion 22 respectively inserted into the upper round ground slot 111 and the lower round ground slot 112 for receiving the round ground prong 32 or 32' of an electric plug 3 or 3', and a bridge portion 23 disposed in contact with the ground terminal 1141 in the flat ground slot 114. (Further, a coupling groove is provided at the face panel 11 around the hot and neutral slots 13 and the flat ground slot 114 for receiving the shell of a computer power plug when the ground prong and hot and neutral blades of the computer are respectively inserted into the ground slot 114 and the hot and neutral slots 13).

Figure 4:
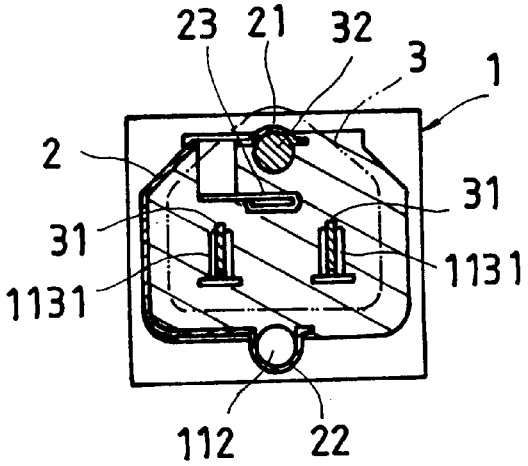
FIG. 4 is an installed view in section of FIG. 1.

Referring to FIGS. 1 and 4 again, when installed in the combination electric socket 1, the round ground prong 32 and flat hot and neutral blades 31 of the electric plug 3 are respectively retained in the top round ground slot 111 and hot and neutral slots 113 at the combination electric socket 1 in close contact with the top contact portion 21 of the ground frame 2 and the hot and neutral terminals 1131.

Figure 2:
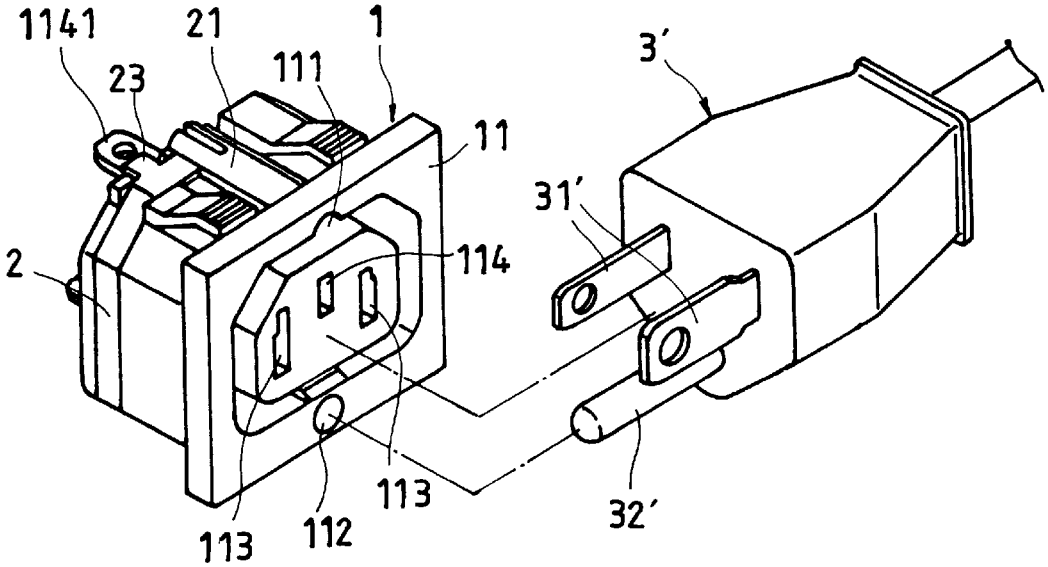
FIG. 2 shows the relationship between a combination electric socket according to the first embodiment of the present invention and another structure of electric plug.
Figure 3:
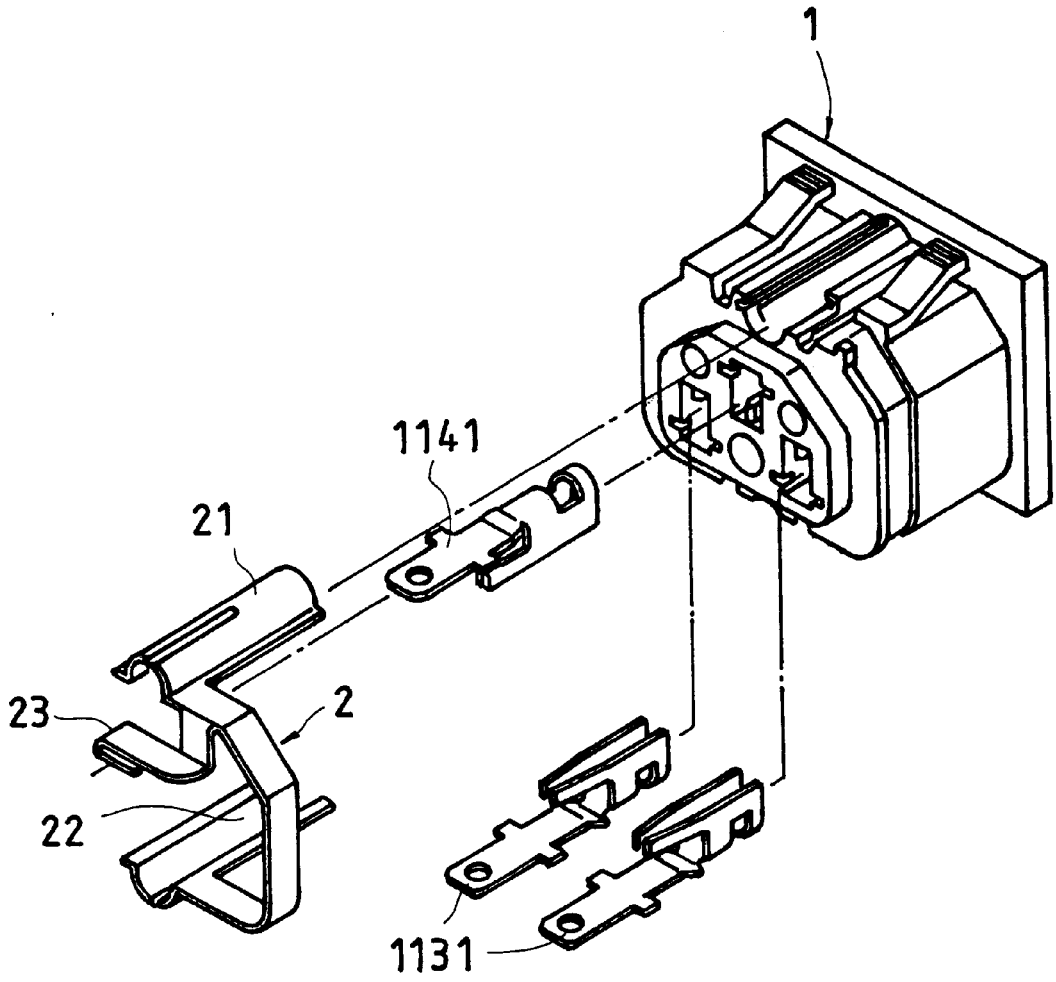
FIG. 3 is an exploded view of the combination electric socket according to the first embodiment of the present invention.
Figure 5:
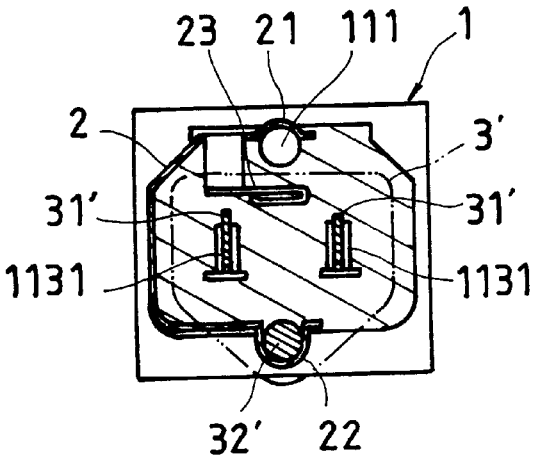
FIG. 5 is an installed view in section of FIG. 2.

Referring to FIGS. 2 and 5 again, when installed in the combination electric socket 1, the round ground prong 32' and flat hot and neutral blades 31' of the electric plug 3 are respectively retained in the bottom round ground slot 112 and hot and neutral slots 113 at the combination electric socket 1 in close contact with the bottom contact portion 22 of the ground frame 2 and the hot and neutral terminals 1131.

Figure 6:
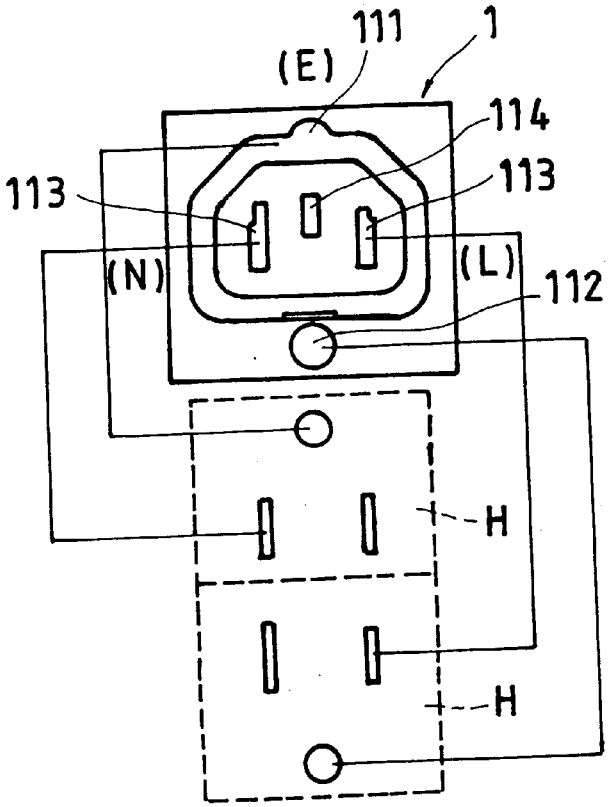
FIG. 6 is a schematic drawing explaining the applicability of the combination electric socket according to the first embodiment of the present invention.
Figure 7:
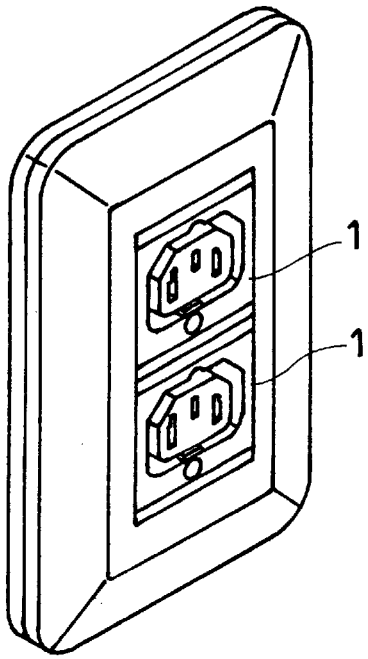
FIG. 7 shows the combination electric socket used in a wall outlet according to the present invention.
Figure 8:
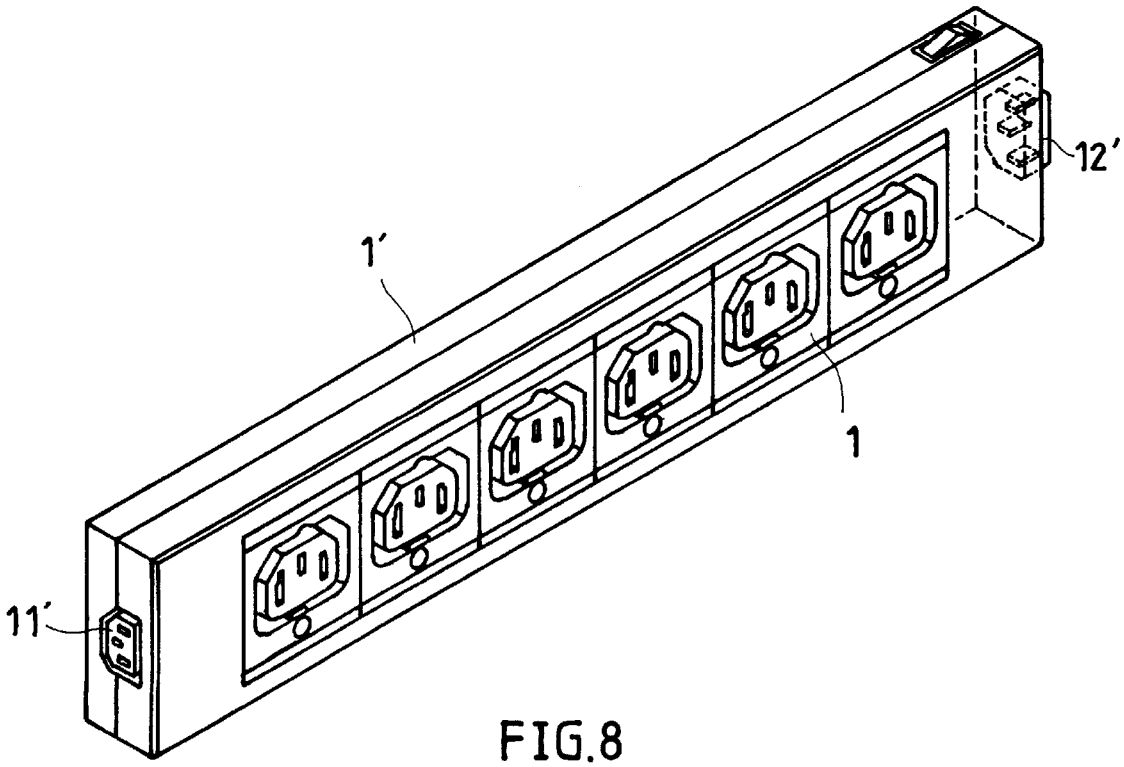
FIG. 8 shows the combination electric socket used in a receptacle assembly for extension cable.

Referring to FIGS. 6, 7 and 8, the aforesaid combination electric socket 1 can be used with an electric plug for computer as well as any of a variety of electric plugs for electric home appliance (see FIG. 6). The combination electric socket 1 can also be used in a wall outlet (see FIG. 7), or a receptacle assembly 1' for extension cable (see FIG. 8). The receptacle assembly 1' has a female connector 11' at one end, a male connector 12' at an opposite end, and a plurality of combination electric sockets 1 connected in series between the female connector 11' and the male connector 12'. By means of the connectors 11' and 12', the receptacle assembly 1' can be connected to the power plug of a computer, or a plurality of receptacle assemblies 1' of the same structure can be connected in series.

Figure 9:
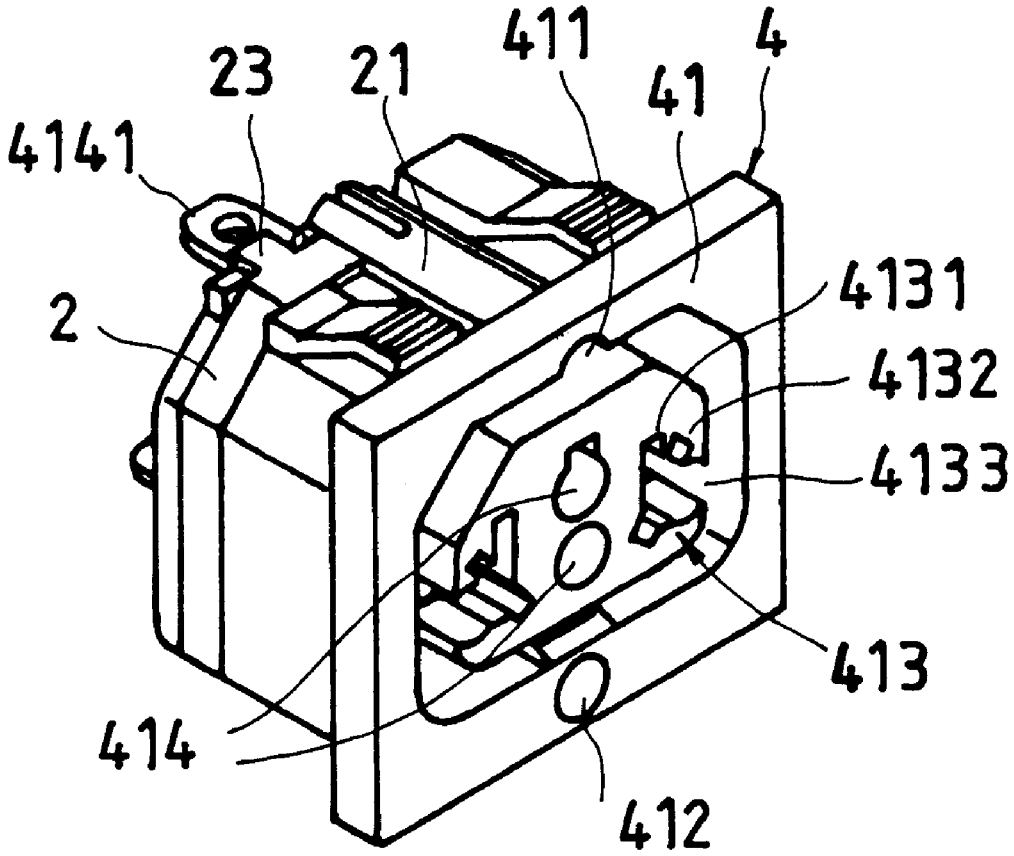
FIG. 9 is a perspective view of a combination electric socket according to a second embodiment of the present invention.
Figure 10:
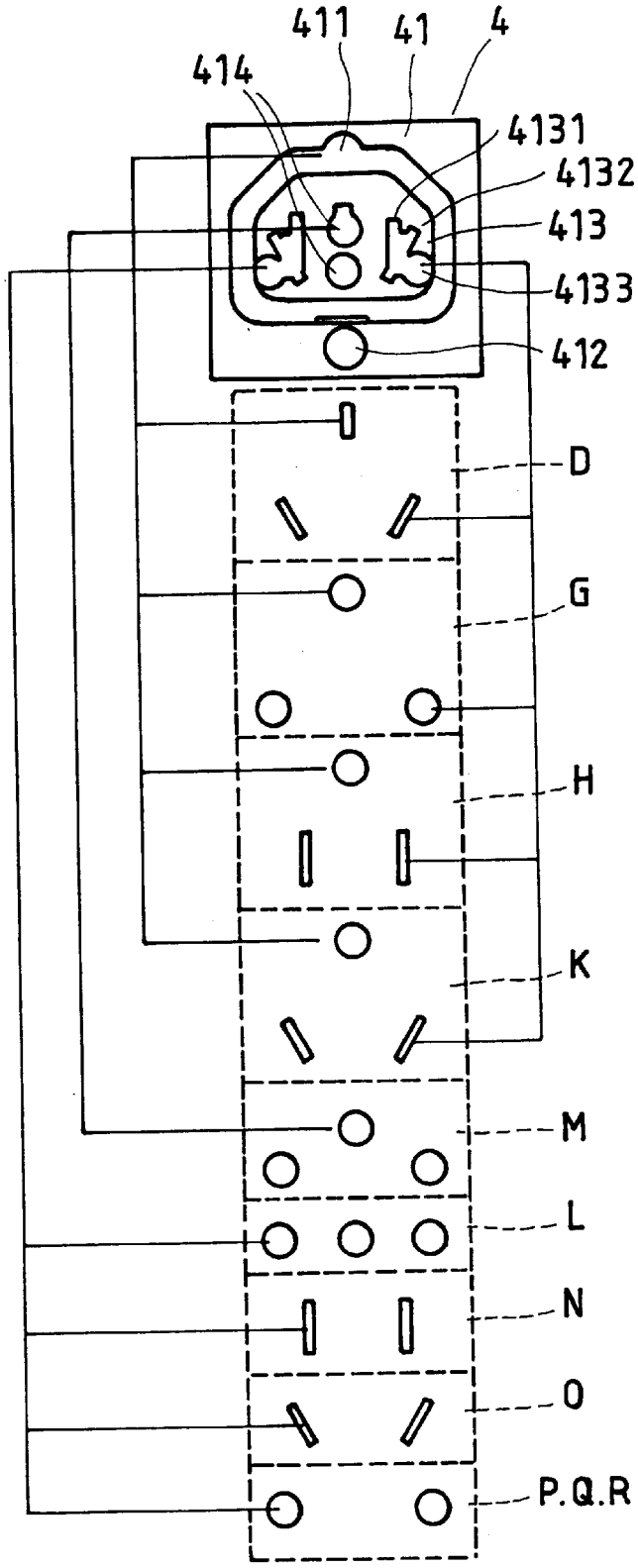
FIG. 10 is a schematic drawing explaining the applicability of the combination electric socket according to the second embodiment of the present invention.

FIGS. 9 and 10 show a combination electric socket 4 according to a second embodiment of the present invention. According to this embodiment, the combination electric socket 4 comprises a face panel 41, an upper round ground slot 411 and a lower round ground slot 412 provided at the face panel 41 on the middle at different elevations, two intermediate ground terminals 414 vertically spaced between the upper round ground slot 411 and the lower round ground slot 412, two hot and neutral slots 413 arranged in parallel at the face panel 41 at two opposite sides of the intermediate ground terminals 414, and a ground frame 2 at the rear side. The hot and neutral slots 413 each are formed of a flat slot 4131, an oblique slot 4132, and a round slot 4133. The ground frame 2 comprises a top contact portion 21 and a bottom contact portion 22 (not shown) respectively inserted into the upper round ground slot 411 and the lower round ground slot 412, and a bridge portion 23 disposed in contact with the ground terminals 4141 in the intermediate ground slots 414. This embodiment can be used with any of a variety of electric plugs used in China, New Zealand, Australia, India, Taiwan, Japan, U.S.A., Italy, Swiss, Philippines, and Venezuela (see FIGS. 10 and 15).

Figure 11:
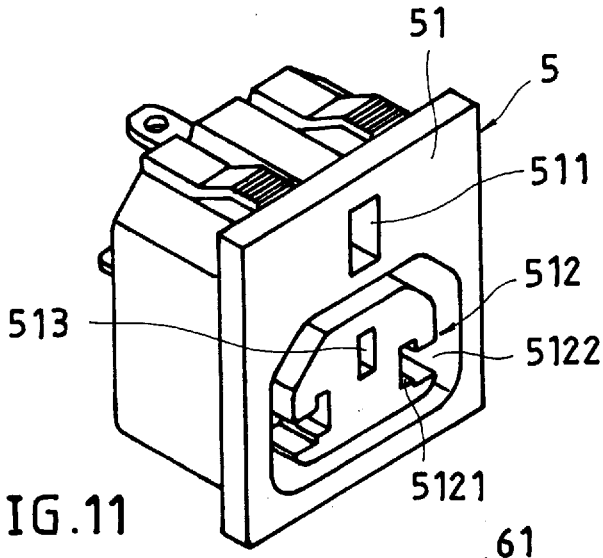
FIG. 11 is a perspective view of a combination electric socket according to a third embodiment of the present invention.

FIG. 11 shows a combination electric socket according to a third embodiment of the present invention. According to this embodiment, the combination electric socket 5 comprises a face panel 51, a first ground slot 511 provided at the face panel 51 on the middle near the top, hot and neutral slots 512 bilaterally provided at the face panel 51 near the bottom, and a second ground slot 513 provided at the face panel 51 on the middle below the first ground slot 511. The hot and neutral slots 512 can be matched with the first ground slot 511 or second ground slot 513 to receive any of different electric plugs. The hot and neutral slots 512 each are formed of a flat slot 5121 and a British rectangular slot 5122. This embodiment can be used with a computer power plug or British electric plug (see also FIGS. 14 and 15).

Figure 12:
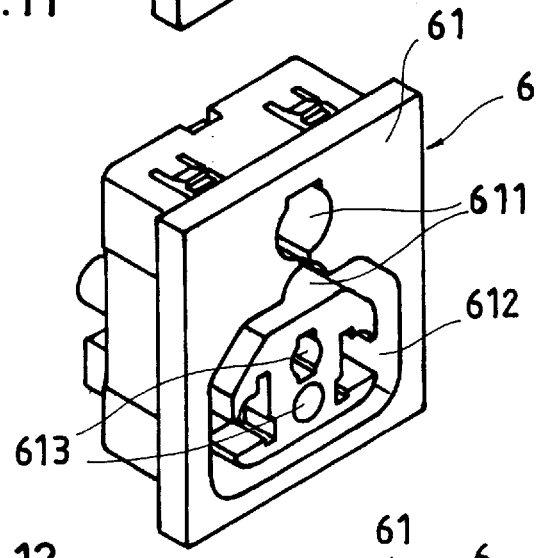
FIG. 12 is a perspective view of a combination electric socket according to a fourth embodiment of the present invention.

FIG. 12 shows a combination electric socket according to a fourth embodiment of the present invention. According to this embodiment, the combination electric socket 6 comprises a face panel 61, two big ground slots 611 vertically spaced at the face panel 61 on the middle near the top, hot and neutral slots 612 bilaterally provided at the face panel 61 near the bottom, and two small ground slot 513 vertically spaced at the face panel 61 on the middle below the big ground slots 611 and between the hot and neutral slots 612. This embodiment is suitable for use in various countries (see also FIGS. 14 and 15).

Figure 13:
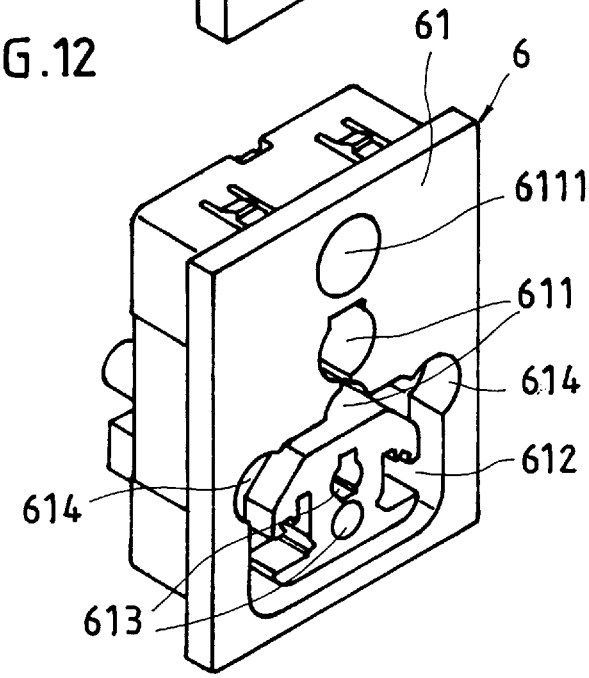
FIG. 13 is a perspective view of a combination electric socket according to a fifth embodiment of the present invention.
Figure 14:
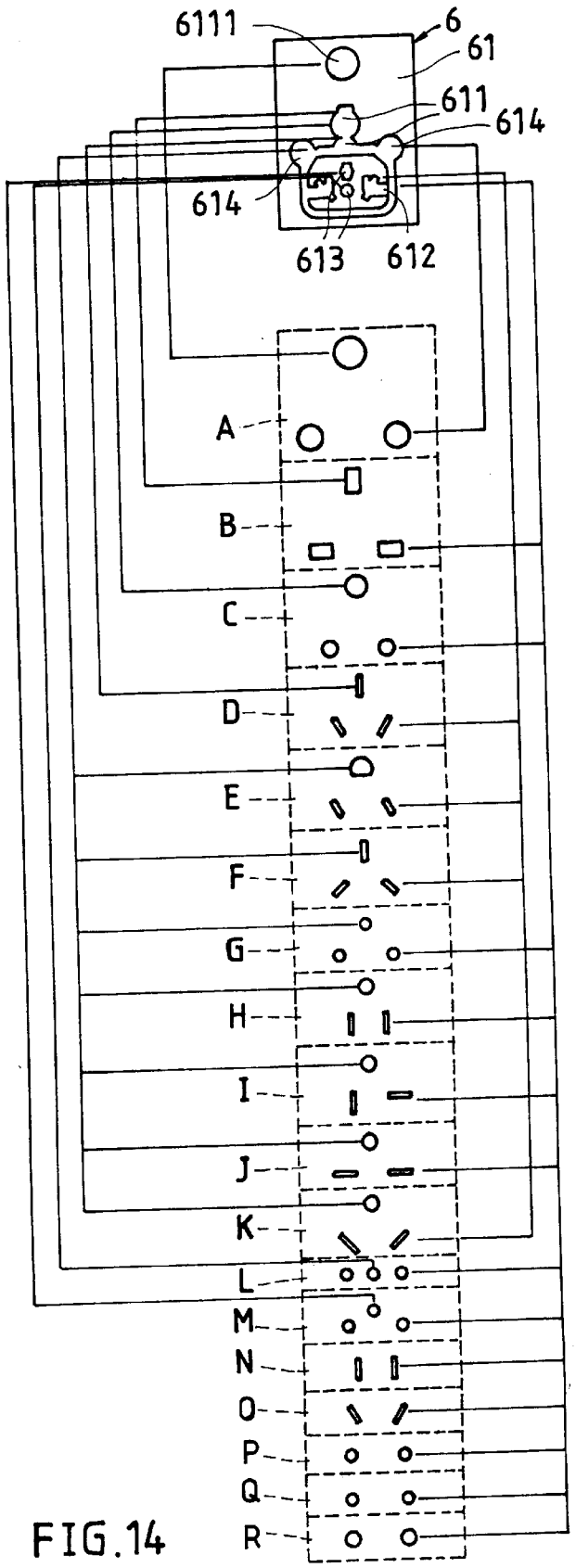
FIG. 14 is a schematic drawing explaining the applicability of the combination electric socket according to the fifth embodiment of the present invention.
Figure 16:
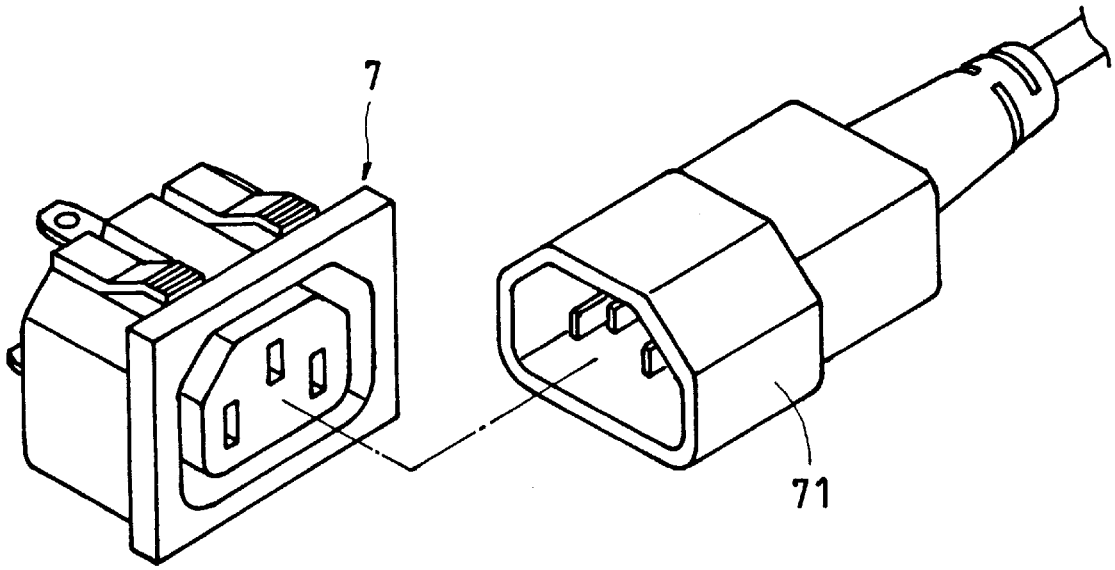
FIG. 16 illustrates the relationship between a standard electric socket for computer and a standard electric plug for computer according to the prior art.

FIG. 13 shows a combination electric socket according to a fifth embodiment of the present invention. According to this embodiment, the combination electric socket 6 comprises a face panel 61, two big ground slot 611 vertically spaced at the face panel 61 on the middle near the top, hot and neutral slots 612 bilaterally provided at the face panel 61 near the bottom, two small ground slot 513 vertically spaced at the face panel 61 on the middle below the big ground slots 611 and between the hot and neutral slots 612, a round ground slot 6111 and round hot and neutral slots 614 provided at the face panel 61 for receiving an electric socket fitting South Africa's national electric specifications. The applicability of this embodiment is shown in FIGS. 14 and 15.

It is to be understood that the drawings are designed for purposes of illustration only, and are not intended as a definition of the limits and scope of the invention disclosed.

What is claimed is:

1. An electric combination socket comprising:

a socket body, said socket body comprising a face panel formed on a front end thereof and a recess formed adjacent a rear end of said socket body and extending continuously along a perimeter portion of said socket body from an upper surface to a lower surface, said face panel having (a) an upper round ground slot formed centrally therethrough adjacent a top portion of said face panel, (b) flat hot and neutral slots arranged in parallel formed through said face panel below said upper round ground slot for matching with said upper round ground slot to receive an electric plug from an electric home appliance, (c) a flat ground slot formed through said face panel between said hot and neutral slots for matching with said hot and neutral slots to receive a computer power plug, (d) a coupling groove formed in said face panel, said coupling groove intersecting said upper round ground slot and circumscribing said hot and neutral slots and said flat ground slot for receiving a shell of a computer power plug therein, and (e) a lower round ground slot formed centrally therethrough adjacent a bottom portion of said face panel external to said coupling groove for matching with said flat hot and neutral slots to receive an electric plug from an electric home appliance;

a ground terminal mounted in said flat ground slot;

hot and neutral terminals respectively mounted in said hot and neutral slots; and a ground frame disposed within said recess of said socket body, said ground frame comprising a top contact portion inserted into the upper round ground slot of said socket body, a bottom contact portion inserted into said lower round ground slot, and a bridge portion disposed in contact with said ground terminal.

2. The electric combination socket of claim 1 further comprising:

a second socket body, said second socket body including a second face panel formed on a front end thereof and a recess formed adjacent a rear end of said second socket body and extending continuously along a perimeter portion of said second socket body from an upper surface to a lower surface, said second face panel having (a) an upper round ground slot formed centrally therethrough adjacent a top portion of said second face panel, (b) flat hot and neutral slots arranged in parallel formed through said second face panel below said upper round ground slot for matching with said upper round ground slot to receive an electric plug from an electric home appliance, (c) a flat ground slot formed through said second face panel between said hot and neutral slots for matching with said hot and neutral slots to receive a computer power plug, (d) a coupling groove formed in said second face panel, said coupling groove intersecting said upper round ground slot and circumscribing said hot and neutral slots and said flat ground slot for receiving a shell of a computer power plug therein, and (e) a lower round ground slot formed centrally therethrough adjacent a bottom portion of said second face panel external to said coupling groove for matching with said flat hot and neutral slots to receive an electric plug from an electric home appliance;

a second ground terminal mounted in said flat ground slot;

second hot and neutral terminals respectively mounted in said hot and neutral slots of said second face panel; and a second ground frame disposed within said recess of said second socket body, said second ground frame comprising a top contact portion inserted into the upper round around slot of said second socket body, a bottom contact inserted into said lower round ground slot of said second socket body, and a bridge portion disposed in contact with said ground terminal;

said first and second socket bodies being stacked one upon the other for mounting in a wall mounted electrical box to define an electrical wall outlet.

3. An electrical wall outlet receptacle having combination electric sockets, said receptacle comprising:

pair of socket bodies stacked one upon the other, each of said socket bodies including a face panel formed on one end of said socket body, a recess formed adjacent an opposing rear end of said socket body and extending continuously along a perimeter portion of said socket body from an upper surface to a lower surface, hot and neutral slots bilaterally formed through said face panel, a ground slot formed through said face panel and equally spaced between said hot and neutral slots at an elevation above said hot and neutral slots, and a coupling groove formed in said face panel and circumscribing said hot and neutral slots and said ground slot for receiving a shell of a computer power plug therein, said face panel having an upper round ground slot formed centrally therethrough adjacent a top portion of said face panel and intersecting said coupling groove, and a lower round ground slot formed centrally therethrough adjacent a bottom portion of said face panel external to said coupling groove;

a ground terminal mounted in said ground slot;

hot and neutral terminals respectively mounted in said hot and neutral slots; and a ground frame disposed within said recess of said socket body, said ground frame comprising a top contact portion inserted into the upper round ground slot of said socket body, a bottom contact portion inserted into said lower round ground slot, and a bridge portion disposed in contact with said ground terminal.

4. A combination electric socket comprising:

a socket body, said socket body including a face panel formed on one end of said socket body, hot and neutral slots bilaterally formed through said face panel, a pair of intermediate ground slots formed through a central portion of said face panel and being vertically spaced between said hot and neutral slots, a coupling groove formed in said face panel and circumscribing said hot and neutral slots and said intermediate ground slots for receiving a shell of a computer power plug therein, said hot and neutral slots each being formed by a combination of a flat slot, an oblique slot, and a round slot, said face panel having an upper ground slot formed therethrough and intersecting said coupling groove for matching with said hot and neutral slots to receive an electric plug from an electric home appliance, said face panel having a lower round ground slot formed centrally therethrough adjacent a bottom portion of said face panel external to said coupling groove for matching with said flat hot and neutral slots to receive an electric plug from an electric home appliance, said socket body having a recess formed adjacent a rear end thereof and extending continuously along a perimeter portion of said socket body from an upper surface to a lower surface;

hot and neutral terminals respectively mounted in said hot and neutral slots;

two ground terminals respectively mounted in said pair of intermediate ground slots; and a ground frame disposed within said recess of said socket body, said ground frame comprising a top contact portion inserted into the upper ground slot of said socket body, a bottom contact portion inserted into said lower round ground slot of said socket body, and a bridge portion disposed in contact with said ground terminals.

* * * * *